United States Patent [19]

Kobayashi et al.

[11] Patent Number: 4,651,645

[45] Date of Patent: Mar. 24, 1987

[54] SUBLIMATION INK RIBBON

[75] Inventors: Naotake Kobayashi; Tetsuya Abe; Satoru Shinohara; Yoshio Fujiwara, all of Kanuma, Japan

[73] Assignee: Sony Corporation, Tokyo, Japan

[21] Appl. No.: 711,464

[22] PCT Filed: Jun. 26, 1984

[86] PCT No.: PCT/JP84/00329

§ 371 Date: Feb. 26, 1985

§ 102(e) Date: Feb. 26, 1985

[87] PCT Pub. No.: WO85/00322

PCT Pub. Date: Jan. 31, 1985

[30] Foreign Application Priority Data

Jun. 30, 1983 [JP] Japan ..... 58-118901

[51] Int. Cl.[4] ..... B41M 5/26

[52] U.S. Cl. ..... 101/470; 400/120; 400/241.1; 400/240.3; 400/240.4; 428/341; 428/913; 428/914

[58] Field of Search ..... 400/118, 119, 120, 240, 400/240.3, 240.4, 241, 241.1, 241.2; 101/470; 428/913, 914, 341; 106/20, 22, 23, 27, 28, 29, 30, 31, 32; 8/471, 472

[56] References Cited

U.S. PATENT DOCUMENTS

| | | | |
|---|---|---|---|
| Re. 27,892 | 1/1974 | Blake | 101/470 |
| 3,632,291 | 1/1972 | Defago et al. | 101/470 X |
| 3,647,503 | 3/1972 | Mizutani et al. | 428/914 X |
| 4,029,467 | 6/1977 | Defago et al. | 428/913 X |
| 4,042,545 | 8/1977 | Defago et al. | 106/32 X |
| 4,444,833 | 4/1984 | Moriguchi et al. | 428/913 X |
| 4,490,435 | 12/1984 | Oshima et al. | 428/341 |
| 4,541,340 | 9/1985 | Peart et al. | 101/470 |
| 4,558,329 | 12/1985 | Honda | 400/240.3 X |

FOREIGN PATENT DOCUMENTS

| | | | |
|---|---|---|---|
| 98641 | 9/1974 | Japan . | |
| 88016 | 8/1976 | Japan . | |
| 0133908 | 10/1979 | Japan | 101/470 |
| 109787 | 8/1981 | Japan . | |

*Primary Examiner*—Ernest T. Wright, Jr.

*Attorney, Agent, or Firm*—Hill, Van Santen, Steadman & Simpson

[57] ABSTRACT

The present invention relates to a sublimation ink ribbon capable of printing on a printing paper a still picture image of various kinds of picture images such as a picture image shot by a video camera, a television picture image and the like. At least the surface of its sublimation ink layer is made of a layer containing a sublimation dye whose solubility relative to methyl ethyl ketone is not higher than 2.5g/100 ml or a layer in which a sublimation dye having a solubility higher than 2.5g/100 ml is mixed such that a ratio (P/B) of a weight P of the sublimation dye relative to a weight B of a binder is not higher than 0.5. Thus, it is possible to reduce the under layer soil characteristics.

3 Claims, No Drawings

SUBLIMATION INK RIBBON

DESCRIPTION

1. Technical Field

The present invention relates to a sublimation ink ribbon capable of printing on a printing paper a still picture image of various picture images such as a picture image shot by a video camera, a television picture image and so on to thereby obtain a hard copy.

2. Background Art

To print the above picture image on a printing paper, there is known a method in which a sublimation ink ribbon coated with a sublimation dye is superposed on the printing paper to which the heat of a pattern corresponding to the picture image information is applied by a thermal print head and the sublimation dye coated on the ink ribbon is sublimated and then transferred to the printing paper in accordance with the above pattern.

According to the thermal sublimation ink ribbon in which the sublimation dye is sublimated and transferred to the printing paper by the thermal print head to thereby obtain a picture image as described above, an ink provided by dissolving and dispersing a sublimation dye into a resin and a solvent is coated on a thin base material with heat-resisting property such as a paper and the like, the base material is heated at its back side by the thermal print head to sublimate only the dye contained in the ink and this dye is transferred to a printing paper coated on its surface with a resin such as polyester resin having excellent dye adsorbing property, whereby to form a color picture image.

The thermal sublimation ink ribbon used for this purpose is required to be capable of sublimating and transferring the sublimation dye in high concentration and uniformly and to be inhibited from lowering the whiteness degree on the surface of the printing paper except the portion on which the picture image is formed.

Generally, in forming the picture image by transferring the sublimation dye as described above, subtractive primaries of yellow, magenta and cyan are employed, in which three primary colors are sequentially sublimated and transferred. In this case, although the portion in which the three primary colors are transferred upon being superposed on one another becomes black in color, in some cases black ink is separately prepared and transferred to control the black concentration. In this case, if the concentration of the transferred dye is low on the whole, the concentration of the mixed color, particularly of the black and dark colors becomes low on the whole. As a result, the picture image becomes weak and unclear. Further, if the dye to be transferred is not uniformly sublimated and transferred, an unevenness in concentration occurs in the picture image with the result that it is impossible to obtain a fine picture image. A further problem occurs because of a so-called under layer soil phenomenon in which dye is transferred to the printing paper to portions where the transfer of the dye is neither intended nor desired. The resulting printing paper is colored differently from the image to be transferred, resulting in a reduced clarity and quality of the picture.

The present invention is to provide a thermal sublimation ink ribbon capable of sublimating and transferring to a printing paper a sublimation dye in high concentration and uniformly by a thermal print head so as to produce a uniform and clear picture image and which can effectively prevent the so-called under layer soil phenomenon in which a dye is transferred and colored on a printing paper in portions other than the portions of the printing paper on which the picture image is formed.

As a result of various experiments and considerations regarding the cause of the under layer soil phenomenon the present inventors found that one of the main causes thereof is that a dye appearing on the surface of the ink ribbon adheres to the printing paper and that another cause is that undesirable crystallization of the dye occurs in the ink layer and crystallized dye is apt to be dropped from the ink layer and transferred to the printing paper.

The present inventors found that one of the main causes of these phenomena is that when the dye is dissolved and dried, the dye is re-crystallized and the crystal of the dye becomes a nucleus so as to promote the crystallization and that depending on the preservation circumstances, this phenomenon is considerably promoted and hence the above ink ribbon becomes an undesirable ink ribbon.

After various experiments and considerations on the basis of these researches, the present invention can provide a sublimation ribbon having a very small under layer soil phenomenon caused in portions except in which the picture image is formed.

DISCLOSURE OF INVENTION

In this invention, a sublimation and transfer ink layer is formed on a base material made of, for example, a condenser paper by a gravure coating technique and the like. In this case, when at least the surface layer of the ink layer is made by using a sublimation dye whose solubility in methyl ethyl ketone (weight of dye that is dissolved into 100 ml of methyl ethyl ketone) is not higher than 2.5 g/100 ml regardless of mixing ratio with the binder, or using a sublimation dye whose solubility is higher than 2.5 g/100 ml in which a ratio (P/B (weight) ratio) of amount P of dye relative to amount B of an ink binder is not higher than 0.5.

When the amount of the sublimation dye whose solubility in the methyl ethyl ketone is higher than 2.5 g/100 ml is used with the P/B ratio beyond 0.5, upon drying the ink, the crystallization of the dye is rapidly promoted on the surface of the ink and further due to the change of the circumstance upon preservation, the crystallization of the ink is promoted to thereby cause the under layer soil phenomenon. However, it was found that an ink made of a sublimation dye whose solubility in the methyl ethyl ketone is not higher than 2.5 g/100 ml made it possible to suppress the dye crystallization considerably on the printed surface upon coating and drying so the coated paper was stable during succeeding preservation, and hence with no under layer soil. Furthermore, in a dye whose solutility relative to methyl ethyl ketone is higher than 2.5 g/100 ml, when its P/B ratio is not higher than 0.5, crystallization upon drying the ink can be suppressed to the extent under which the under layer soil phenomenon is not affected. Accordingly, it does not matter that within this range, the dye is mixed with a dye whose solubility is not higher than 2.5 g/100 ml or the dye is used alone. However, when a dye having a relatively high solubility is used, if the mixing ratio is reduced as much as possible, this brings about a preferable result to the stableness of the ink ribbon.

In obtaining an ink ribbon, when an ink containing there in a sublimation dye is coated on a heat-resisting base material by the gravure coater, if printing irregularity occurs, this printing irregularity appears as a concentration irregularity in a printed picture image. This causes picture quality to be lowered. In order to coat the ink uniformly, the number of lines on the gravure plate must be increased as much as possible and the depth of the gravure plate must not be higher than 40 to 50 microns. On the other hand, from a coloring concentration standpoint, it is preferable that the coating amount of the ink is increased as much as possible. If the depth of the gravure plate is not higher than 40 to 50 microns, the coloring concentration will become insufficient.

These problems can be solved by the technique in which the sublimation ink is printed to be more than, for example, a double layer and at least the surface layer is formed by the ink layer that is specified in this invention. Thus, it is possible to obtain a uniform and clear picture image of high concentration and having no under layer soil.

BEST MODE FOR CARRYING OUT THE INVENTION

EXAMPLE 1

Regarding dyes having solubilities in the methyl ethyl ketone (MEK) as shown in the following table 1, inks were made in accordance with the following mixing examples and coated on one surface of a condenser paper by using a gravure plate with 185 lines/inch and 40 microns in depth, thus making ink ribbons (samples 1 to 7). Then, picture images were formed on printing paper by a printer and the condition of the under layer soil was observed. The evaluated results of such observation were indicated on Table 1. In Table 1, the item of "before aging" represents a case immediately after the ink ribbon is formed, while the item of "after aging" represents a case in which the ink ribbon is preserved in an atmosphere of 40° C. and a relative humidity of 90% for three days and then printed on the printing paper. In Table 1, a mark "O" indicates a case in which no under layer soil is observed, a mark "Δ" indicates a case in which a slight amount of the under layer soil is observed and a mark "x" indicates a case in which the under layer soil occurs.

The mixing example:

binder (cellulose acetate): one part by weight
dye: one part by weight
silica powder: one part by weight
solvent (MEK): 27 parts by weight

TABLE 1

| Sample Nos. | Names of Dyes | Solubility (g/100 ml) | Degree of under layer soil before aging | Degree of under layer soil after aging |
|---|---|---|---|---|
| 1 | Dioperse Blue 20 (product name manufactured by Mitsui Toatsu chemicals, Inc. | 0.43 | O | O |
| 2 | TS Yellow 103 (product name manufactured by Sumitomo Chemical Co., Ltd.) | 0.6 | O | O |
| 3 | Sumiplast FB (product name manufactured by Sumitomo Chemical Co., Ltd.) | 1.4 | O | O |
| 4 | Miketone fast brilliant blue B (product name manufactured by Mitsui Toatsu Chemicals, Inc.) | 2.2 | O | O |
| 5 | Sumiplast blue OA (product name manufactured by Sumitomo Chemical Co., Ltd.) | 2.6 | O | Δ |
| 6 | Sumiplast yellow FC (product name manufactured by Sumitomo Chemical Co., Ltd.) | 3.3 | Δ | x |
| 7 | Sumiplast blue S35 (product name manufactured by Sumitomo Chemical Co., Ltd.) | 3.6 | x | x |

In Table 1, as will be clear from the comparison of the samples 1 to 4 with the samples 5 to 7 in which the solubility is higher than 2.5 g/100 ml, even in the case of P/B=1 which is higher than P/B=0.5, if the solubility is not higher than 2.5 g/100 ml, it is possible to avoid the under layer soil.

EXAMPLE 2

While changing the mixing ratio R of yellow dye P2 whose solubility relative to the MEK is higher than 2.5 g/100 ml (about 2.7 g/100 ml), to yellow dye P1 whose solubility relative to the MEK is not higher than 2.5 g/100 ml (about 0.6 g/100 ml) (R=P2/P1), the ink ribbons were made by a similar method to that of Example 1 and picture images were formed on the printing paper by the printer and the state of the under layer soil was observed. The results thereof are indicated in Table 2. In this case, P/B on the whole is 1.

TABLE 2

| | R | | | | |
|---|---|---|---|---|---|
| under layer soil | 0.1 | 0.3 | 0.5 | 0.7 | 1.0 |
| before aging | O | O | O | O | Δ |
| after aging | O | O | O | Δ | x |

As will be clear from the results indicated in Table 2, of the dyes whose solubility relative to the MEK is higher than 2.5 g/100 ml, if the solubility is as relatively low as 2.7 g/100 ml, it is possible to mix the dye so as to make P/B equal to near 0.5.

EXAMPLE 3

While changing the mixing ratio R(P2/P1) of the cyan dye P1 whose solubility relative to the MEK is not higher than 2.5 g/100 ml (about 2.2 g/100 ml) with the cyan dye $P_2$ whose solubility relative to the MEK is higher than 2.5 g/100 ml (about 3.6 g/100 ml), the ink ribbons were made by a similar method to that of Example 1 and picture images were formed on the printing paper by the printer and the state of the under layer soil was observed. In this case, the P/B on the whole is 1.

TABLE 3

| | R | | | | |
|---|---|---|---|---|---|
| under layer soil | 0.1 | 0.3 | 0.5 | 0.7 | 1.0 |
| before aging | O | O | Δ | Δ | x |
| after aging | O | O | Δ | x | x |

As will be clear from the above results, it was understood that of the dyes whose solubility relative to the MEK was higher than 2.5 g/100 ml, if the solubility was higher than 3.6 g/100 ml, it was desired that the P/B of the dye whose solubility was higher than 2.5 g/100 ml was mixed so as to be less than 0.5.

According to the above examples, it is understood that under layer soil can be avoided by specifying the relation between the solubility of the dye relative to the MEK and the binder.

As will be clear from the above description, according to the sublimation ink ribbon of the present invention, upon printing on printing paper, under layer soil can effectively be avoided so that it is possible to print a picture image of high contrast and clear and high quality thus bringing about a large practical advantage.

We claim:

1. A sublimation ink ribbon consisting of a heat-resisting base material and an ink layer coated on at least one surface thereof and formed by mixing at least a sublimation dye and a binder, characterized in that at least the surface of said ink layer is made of a layer containing a sublimation dye whose solubility in methyl ethyl ketone is not higher than 2.5 g/100 ml.

2. A sublimation ink ribbon consisting of a heat-resisting base material and an ink layer coated on at least one surface thereof and formed by mixing at least a sublimation dye and a binder, characterized in that the surface of said ink layer is made of a layer which consists of a first sublimation dye whose solubility relative to methyl ethyl ketone is not higher than 2.5 g/100 ml and a second sublimation dye whose solubility relative to said methyl ethyl ketone is higher than 2.5 g/100 ml, said second sublimation dye being present in an amount such that the ratio (P/B) of the weight P of said second sublimation dye relative to the weight B of said binder is not higher than 0.5.

3. A sublimation ink ribbon consisting of a heat-resisting base material and an ink layer coated on at least one surface thereof and formed by mixing at least a sublimation dye and a binder, characterized in that said ink layer is formed as a multilayer having an uppermost layer thereof formed of a layer containing a sublimation dye whose solubility in methyl ethyl ketone is not higher than 2.5 g/100 ml.

* * * * *